US005248263A

United States Patent [19]

Sakurai et al.

[11] Patent Number: 5,248,263

[45] Date of Patent: Sep. 28, 1993

[54] WATERTIGHT ELECTRIC CONNECTOR

[75] Inventors: Kazuaki Sakurai; Toshiro Maejima; Seiji Kozono; Toshiharu Kudo; Mitsuhiko Totsuka, all of Shizuoka, Japan

[73] Assignee: Yazaki Corporation, Tokyo, Japan

[21] Appl. No.: 797,738

[22] Filed: Nov. 22, 1991

[30] Foreign Application Priority Data

Nov. 22, 1990 [JP] Japan ..... 2-121800[U]

[51] Int. Cl.[5] ..... H01R 13/00

[52] U.S. Cl. ..... 439/271

[58] Field of Search ..... 439/271-276, 439/278-283

[56] References Cited

U.S. PATENT DOCUMENTS 3,605,069 9/1971 Dorrell ..... 439/271

4,529,257 7/1985 Goodman et al. ..... 439/271

4,820,181 4/1989 Kuzuno et al. .

*Primary Examiner*—Joseph H. McGlynn

*Attorney, Agent, or Firm*—Keck, Mahin & Cate

[57] ABSTRACT

A watertight electric connector has a male connector housing, a female connector housing to be mated with the male connector housing, a ring-shaped packing in close contact with an outer wall of the male connector housing, and a slidable protection cover disposed so as to cover the periphery of the packing. The protection cover protects the packing when the connector housings are not mated with each other, and is moved backward by the pressure of the female connector housing when the connector housings are mated. The slidable protection cover has a mechanism capable of making the watertight connector compact, simplifying the handling of the connector, assuring protection of the packing, and enhancing reliability of waterproofing.

11 Claims, 5 Drawing Sheets

WATERTIGHT ELECTRIC CONNECTOR

BACKGROUND OF THE INVENTION

1. Field of the Invention

The present invention relates to a watertight electric connector, and more particularly to watertight electric connectors for use in an electric circuit of a machine or a vehicle to be used outdoors.

2. Description of the Related Art

In an environment where there is a possibility of exposure to rainwater or the like, a watertight electric connector is used to join wire harnesses or a wire harness and an electrical device since short circuit due to intrusion of water, contact failure resulting from oxidation of the surface of a splicing fitting with the passage of time due to moisture, and so on are unallowable from standpoints of electric control and safety management.

Such a watertight electric connector is disclosed in, for example, U.S. Pat. No. 4,820,181. FIG. 6 illustrates the watertight electric connector.

The connector has a watertight packing inserted in the joint between male and female connector housings a and b. Although terminal members are built in the housings a and b, since they have no relation to the watertight structure of the connector, the internal structure of the connector is not illustrated.

In the watertight electric connector, a ring-shaped packing c is set on a mating outer wall $a_1$ of the male connector housing a so as to complete a watertight joint between the outer wall $a_1$ and an inner engaging surface $b_1$ of a columnar portion of the female connector housing b. If the outer surface of the packing c is exposed, scrapes are physically formed on the outer surface by rubbing during connection of electric wires to a wire harness, and transportation, storage and attachment of the connector subsequent to the connection, so that the watertight effect of the packing c is hindered by the scrapes. In order to solve the above problem, a fixed protection wall $a_2$ is extended from the outer face of the male connector housing a, thereby bringing some effects. However, the necessity of a cavity $a_3$ into which the female connector housing b is inserted leads to the following disadvantages:

First, since the protection wall $a_2$ (outside diameter $D_1$) is disposed outside a columnar portion $b_2$ (outside diameter $D_2$), the dimension of the connector is larger by $D_1-D_2=d$ than that of a connector without the protection wall $a_2$. In order to save the mounting space for a connector in a machine or a vehicle, it has been recently requested that the maximum outside dimension be made as small as possible. In particular, a multiway connector has been strongly required to be small in outside dimension.

Furthermore, when the above protection wall $a_2$ is used, it is likely that dust floating in the air will intrude into the cavity $a_3$, stick to the surface of the packing c, and form minute scrapes on the surface of the packing c due to the slide on the columnar portion inner engaging surface $b_1$ when the connector housings a and b are mated with each other. The scraping is one of causes of intrusion of moisture into the connector. Incorrect operations of an electric control circuit in a machine or a vehicle cannot be absolutely permitted in relation to electronicization and complication thereof. However, some trouble, such as contact failure at an electric joint and increase in electric resistance, still arises due to the intrusion of moisture, and thus the request for a watertight electric connector having improved watertight performance has been increased.

SUMMARY OF THE INVENTION

An object of the present invention is to provide a watertight electric connector capable of solving the above problems.

Another object of the present invention is to provide a compact watertight electric connector without increasing the outside dimension thereof.

Still another object of the present invention is to provide a watertight electric connector capable of protecting the surface of a packing from physical damage.

A further object of the present invention is to provide a watertight electric connector capable of suppressing damage to watertight performance due to sticking of floating dust onto the surface of a packing in processes of production and distribution of the connector, assembling, mounting in a machine and a vehicle and maintenance of wire harnesses, and so on.

A still further object of the present invention is to provide a watertight electric connector having such a mechanism as to make the connector compact, simplify the handling of the connector, assure protection of a packing and enhance waterproofing.

In order to achieve the above objects, there is provided a watertight electric connector in which a ring-shaped packing is mounted in close contact with an outer wall of a connector housing and a slidable protection cover is disposed so as to cover the width of the packing.

According to the above construction, it is possible to prevent a watertight connector from being enlarged and to maintain the sealing effect by protecting a packing disposed on the surface of the connector.

DESCRIPTION OF THE PREFERRED EMBODIMENTS

The present invention will now be described in detail with respect to preferred embodiments shown in the accompanying drawings.

Figure 1:
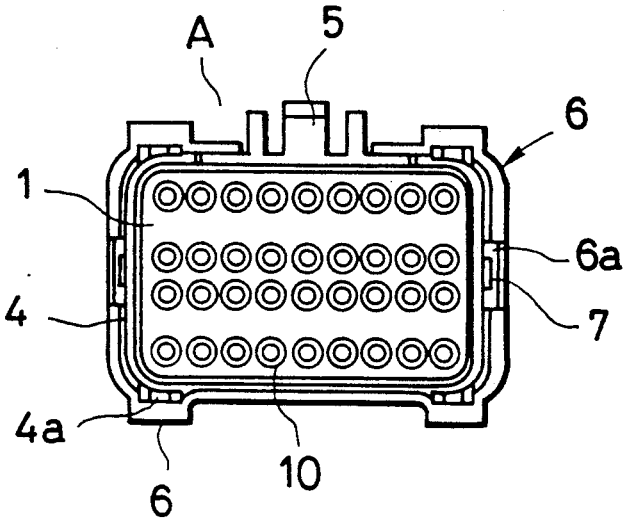
FIG. 1 is a rear view of a male watertight electric connector according to an embodiment of the present invention.
Figure 2A:
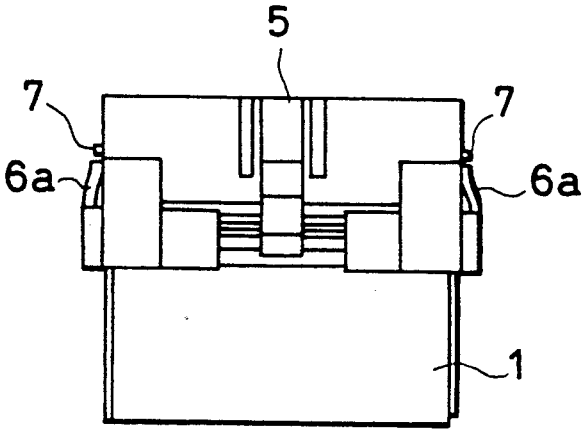
FIG. 2A is a plan view of the connector shown in FIG. 1.
Figure 2B:
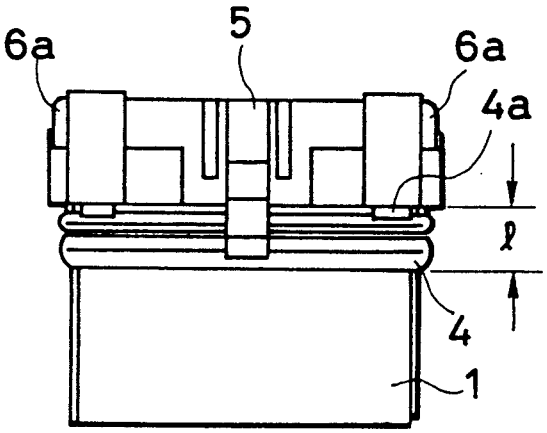
FIG. 2B is a plan view of the connector when a protection cover is slid out.
Figure 3:
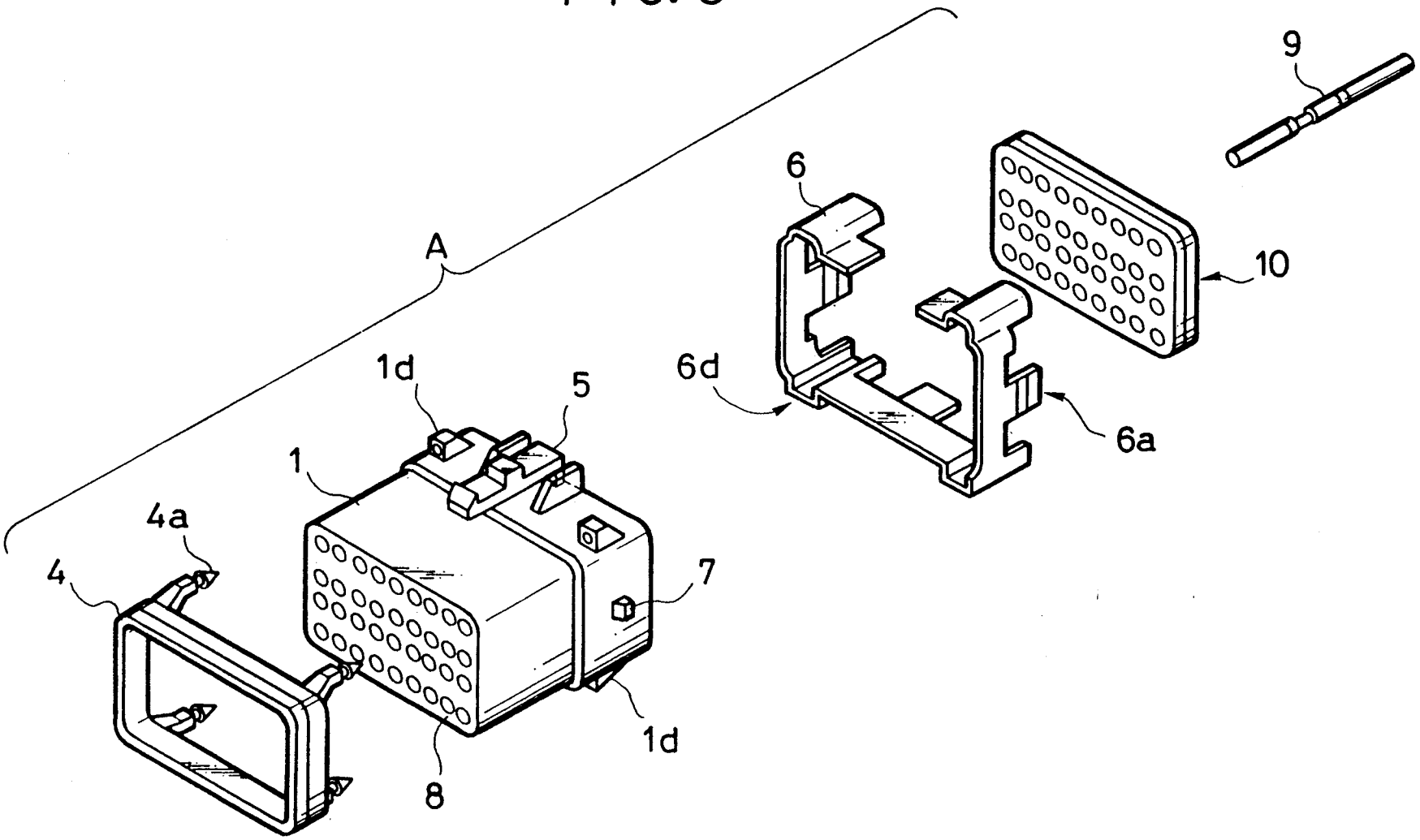
FIG. 3 is an exploded perspective view of the connector shown in FIG. 1.

FIGS. 1 to 3 each illustrate a male watertight electric connector A of the present invention. The male watertight electric connector A is mated with a female watertight electric connector B as shown in FIG. 4. The male and female watertight electric connectors A and B include an insulating housing 1 with an outer wall 1*a* and an insulating housing 2 with a columnar portion 2*a*, respectively.

The insulating housing 1 is formed with a plurality of terminal chambers 8 therein each of which contains a terminal fitting 9, and a watertight plug 10 is attached to the rear end of the insulating housing 1. The insulating housing 1 also has a retaining arm 5 on its top to prevent the housings 1 and 2 of the connectors A and B from separating when the connectors A and B are mated with each other.

A rectangular-frame packing 4 made of soft rubber is mounted around the insulating housing 1. As shown in FIG. 3, the position of the packing 4 is determined by fitting retaining claws 4*a* of the packing 4 in retaining portions 1*d* of the housing 1.

A protection cover 6 made of synthetic resin is mounted around the packing 4. Although the protection cover 6 is fundamentally in the shape of a ring for covering the whole circumference of the packing 4, if there is not sufficient room under the retaining arm 5, a part of the protection cover 6 having a width corresponding to the width of the retaining arm 5 may be cut off. Guide slots 6*d* formed at the four corners of the protection cover 6 are engaged with the retaining portions 1*d* of the housing 1 so as to prevent the protection cover 6 from tilting. Stoppers 7 project from both outsides of the housing 1, thereby determining the attachment position of the protection cover 6. In other words, when the connector housings 1 and 2 are mated with each other, the protection cover 6 for protecting the packing 4 is prevented from moving by the stoppers 7.

When the male connector 1 is mated with the female connector 2, the protection cover 6 is pressed by the female connector 2, and slides backward by a movement stroke length l (shown in FIG. 2B). During this movement, flexible retaining arms 6*a* formed on the protection cover 6 for regulating the position of the protection cover 6 cross the stoppers 7 projecting from the outer wall of the housing 1, slide by the stroke length l, and thus the protection cover 6 is allowed to be detached. Projections 6*b* formed inside the protection cover 6 are brought into contact with the stoppers 7 and locked at the back position, thereby preventing the protection cover 6 from falling toward the wire harness.

Figure 4A:
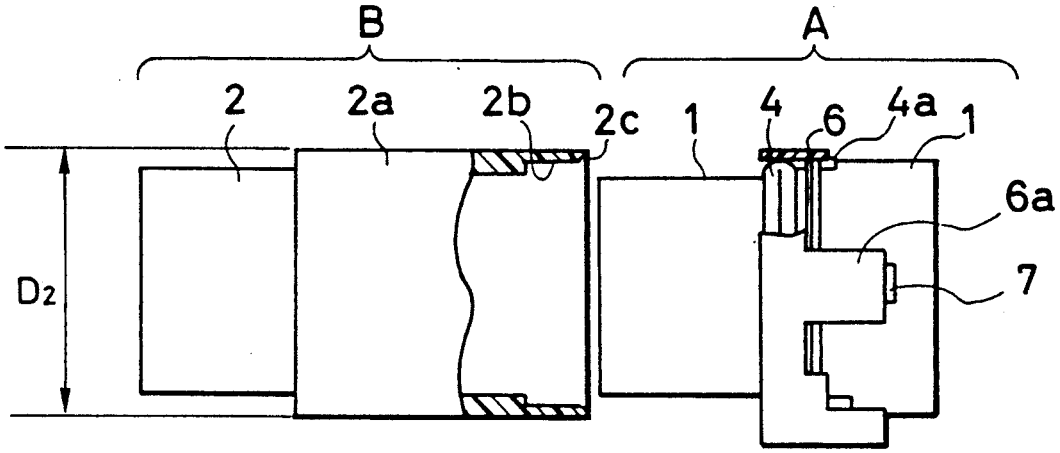
FIGS. 4A to 4D are cross-sectional views showing the changes of state of male and female connectors when they are being mated with each other.

The inside dimension of the slidable protection cover 6 can be, as shown in FIG. 4A, set so that the protection cover 6 is in light contact with the outside of the packing 4 to prevent dust from sticking to the surface of the packing 4. If there is an interval between the surface of the packing 4 and the protection cover 6, dust sticks to the packing 4, and the packing 4 is finely scraped by the slide of an inner engaging surface 2*b* of the columnar portion 2*a* when the male and female connectors 1 and 2 are mated with each other, resulting in insufficient tightness and intrusion of moisture.

Figure 4B:
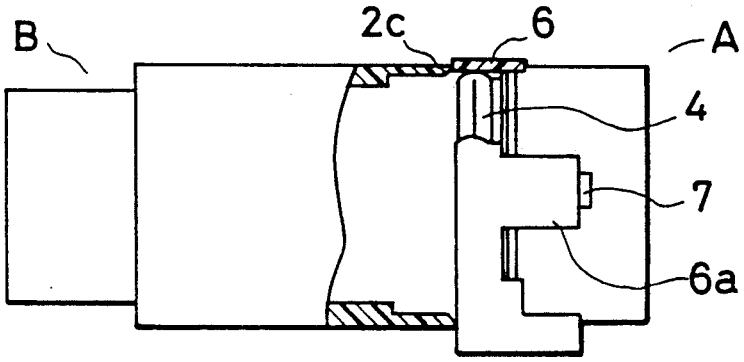
Figure 4C:
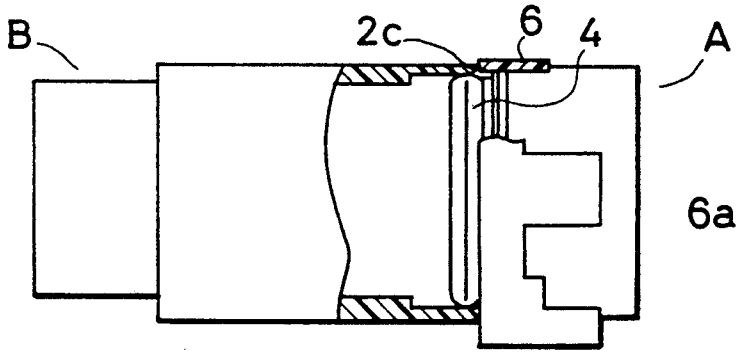
Figure 4D:
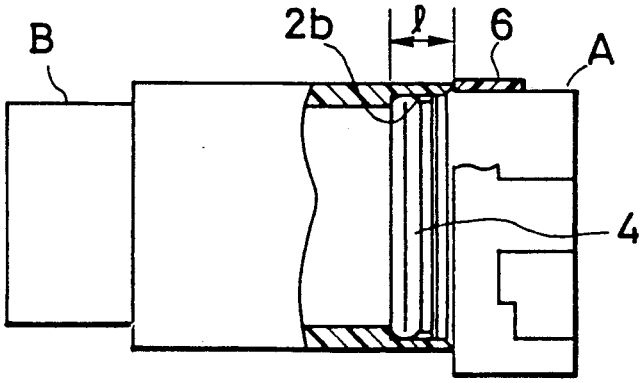
Figure 5A:
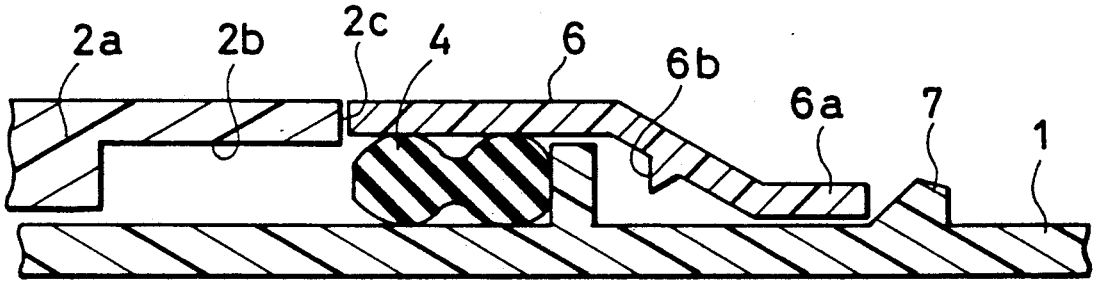
FIGS. 5A to 5C are cross-sectional views showing the operation of a flexible retaining arm for regulating the position of a movable protection cover of the present invention.
Figure 5B:
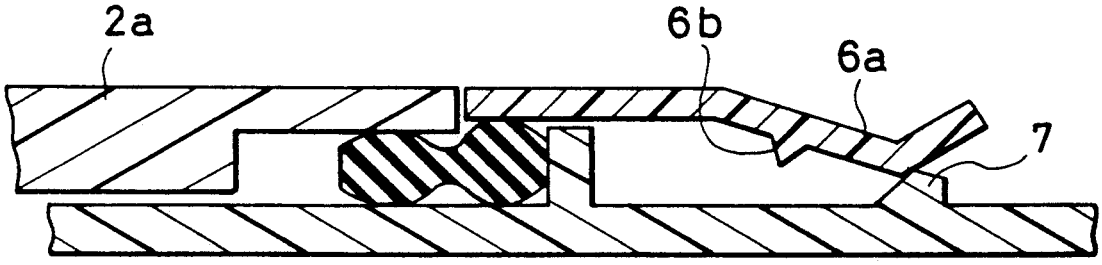
Figure 5C:
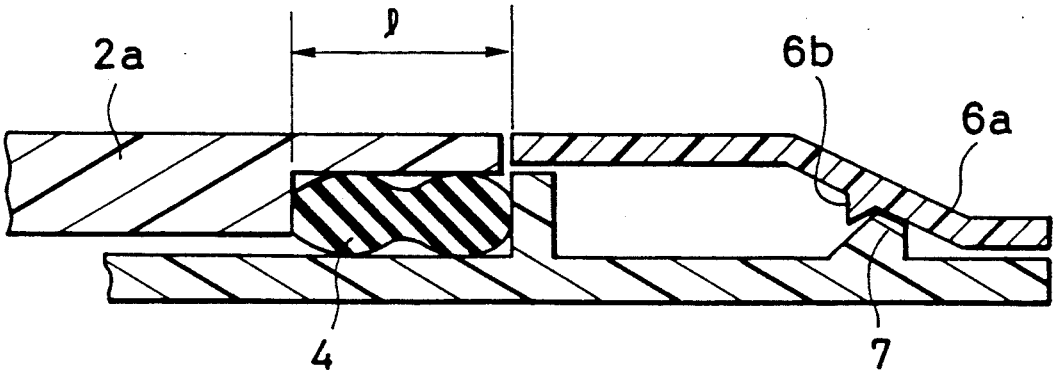
Figure 6:
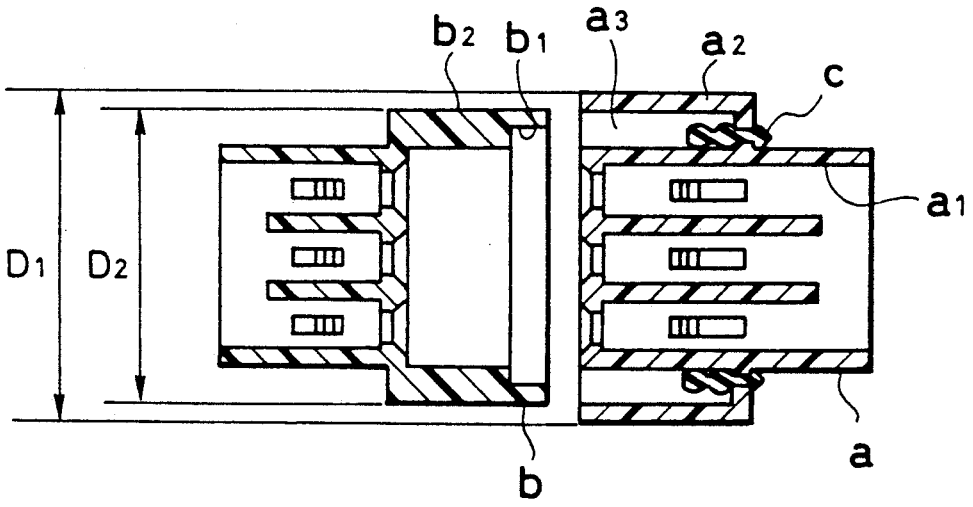
FIG. 6 PRIOR ART
FIG. 6 is a cross-sectional view of male and female connector housings constituting a conventional watertight electric connector.

FIG. 4B shows the state in which a leading face 2*c* of the columnar portion 2*a* is in contact with the protection cover 6 when the male and female connectors 1 and 2 are mated with each other, FIG. 4C shows the state in which the columnar portion inner wall 2*b* faces the surface of the packing 4, the protection cover 6 moves backward, and the flexible retaining arm 6*a* is crossing the stopper 7, and FIG. 4D shows the state in which the mating is completed, the protection cover 6 is stopped, and the flexible retaining arm 6*a* is prevented from falling out as shown in FIG. 5C.

The protection cover 6 directly covers the packing 4 in light contact with the surface of the packing 4, so that dust floating in the air is prevented from sticking to the packing 4.

Since the protection cover 6 has covered the surface of the packing 4 until the male and female connectors 1 and 2 are mated, the packing 4 is prevented from being scraped by dust during the sliding of the packing 4 and the inner engaging surface 2*b* of the columnar portion 2*a* of the female connector B, the tightness of the packing 4 is improved and thus reliability of waterproofing is enhanced.

Furthermore, when the male and female connectors 1 and 2 are separated for inspection and service after the watertight electric connector is mounted in a machine, if the protection cover 6 is set on the packing 4, it is possible to prevent the surface of the packing from being physically damaged and dust from sticking to the packing 4.

What is claimed is:

1. A watertight electric connector, comprising:
a connector housing having an outer wall;
a ring-shaped packing mounted in close contact with said outer wall; and
a slidable protection cover disposed so as to cover the width of said packing.

2. A watertight electric connector according to claim 1, wherein said protection cover has a flexible retaining arm for regulating the movement thereof.

3. A watertight electric connector according to claim 2, wherein said protection cover has a retaining means for stopping the movement of the projection cover in a back position.

4. A watertight electric connector according to claim 3, wherein said retaining means is a projection.

5. A watertight electric connector, comprising:
a male connector housing having an outer wall;
a female connector housing to be mated with said male connector housing;
a ring-shaped packing mounted in close contact with the surface of said outer wall of said male connector housing; and
a slidable protection cover disposed so as to cover the width of said packing, said protection cover being moved backward by the pressure of said female connector housing.

6. A watertight electric connector according to claim 5, wherein said protection cover has a flexible retaining arm for regulating the movement of said protection cover in protection of said packing.

7. A watertight electric connector according to claim 6, wherein each side of said male connector housing has a stopper for engaging said flexible retaining arm and said retaining portion.

8. A watertight electric connector according to claim 6, wherein said protection cover has a retaining means for stopping the movement of the projection cover in a back position.

9. A watertight electric connector according to claim 8, wherein said retaining means is a projection.

10. A watertight electric connector, comprising:
a male connector housing having an outer wall;
a female connector housing having a columnar portion inner wall to be mated with said male connector housing;
a ring-shaped packing mounted in close contact with the surface of said outer wall of said male connector housing, said packing being brought into close contact with said columnar portion inner wall of said female connector housing when said male and female connector housings are mated; and a slidable protection cover disposed so as to cover the width of said packing, said protection cover being moved backward by the pressure of said female connector housing when said male and female connector housings are mated, wherein said male connector housing is formed with retaining portions on the right and left of an upper face of said outer wall, and stoppers on both sides of said outer wall, wherein said packing is formed with retaining claws at the four corners thereof for engaging said retaining portions so as to fix the position of said packing, and wherein said protection cover is formed with flexible retaining arms on its both sides for regulating the movement of said protection cover in cooperation with said stoppers when said male and female connector housings are not mated with each other, and in cooperation with said stoppers when said male and female connector housings are mated with each other and said protection cover is in a back position.

11. A watertight electric connector according to claim 10, wherein at least one of said flexible retaining arms has a projection for engaging one of said stoppers and stopping movement of the protection cover when said male and female connector housings are mated with each other and said protection cover is in a back position.

* * * * *